US005673735A

United States Patent [19]

Crvelin et al.

[11] Patent Number: 5,673,735

[45] Date of Patent: Oct. 7, 1997

[54] PROCESS FOR STORING AND DELIVERING GAS

[75] Inventors: Paul M. Crvelin; Douglas B. Armstrong, both of Niagara Falls, N.Y.

[73] Assignee: Aurora Technology Corporation, East Aurora, N.Y.

[21] Appl. No.: 385,105

[22] Filed: Feb. 7, 1995

[51] Int. Cl.[6] ..... B65B 1/30; B65B 3/28; B65B 57/06; B65B 57/14

[52] U.S. Cl. ..... 141/197; 141/47; 141/54; 141/39; 141/95; 137/256

[58] Field of Search ..... 141/47, 51, 54, 141/197, 39, 83, 95, 99, 4; 123/526, 527; 137/256

[56] References Cited

U.S. PATENT DOCUMENTS 4,261,169 4/1981 Zimmern ..... 60/39.05
5,195,881 3/1993 George, Jr. ..... 418/97
5,406,988 4/1995 Hopkins ..... 141/47
5,409,046 4/1995 Swenson et al. ..... 141/18
5,458,167 10/1995 Schultz et al. ..... 141/39

*Primary Examiner*—Henry J. Recla
*Assistant Examiner*—Timothy L. Maust
*Attorney, Agent, or Firm*—Howard J. Greenwald

[57] ABSTRACT

A process for storing and delivering gas. In the first step of this process, a multiplicity of at least four gas banks is filled with compressed gas to a specified pressure, the gas pressure in each of the gas banks is sequentially measured, a control system sequentially selects one of the gas banks and withdraws gas from it to the device to be filled until the rate of gas flow is less than optimum, the control system then withdraws gas from the next sequential of the gas banks while replenishing the gas in the first depleted of said gas banks.

8 Claims, 4 Drawing Sheets

PROCESS FOR STORING AND DELIVERING GAS

FIELD OF THE INVENTION

A process for storing and delivering gas to an apparatus which will utilize such gas.

BACKGROUND OF THE INVENTION

Compressed natural gas is an abundant resource in the United States of America. It has been estimated that the known resources of natural gas are sufficient to supply the needs of the United States for at least 200 years.

For many years the United States has relied heavily upon imported petroleum products. As was demonstrated by the actions of Middle Eastern countries during the 1973 gasoline crisis, this reliance upon foreign sources of energy is a threat to the economic well being and national security of the United States.

One of the major uses of imported petroleum products is in the production of gasoline for motor vehicles. It would be desirable if the motor vehicles in the United States were able to utilize compressed natural gas rather than gasoline made from foreign oil.

In addition to the economic and national security advantages of using compressed natural gas, such compressed natural gas is superior in other respects to gasoline made from petroleum products. In the first place, it is cheaper. In the second place, it burns more cleanly. In the third place, it is safer, requiring a higher temperature for ignition; and it is only combustible within a specified narrow range of gas concentrations.

The "big three" automakers (General Motors Corporation, Chrysler Corporation, and Ford Motor Company) are well aware of these advantages and, for several years, have been producing motor vehicles which utilize compressed natural gas. Thus, for example, the Dodge Caravan and the Ford Crown Victoria are among the vehicles which are offered with an option for a dedicated natural gas engine.

One major problem with converting all of the motor vehicles in the United States to compressed natural gas engines is that, at the present time, the means for readily supplying natural gas to vehicles throughout every state of the United States is not currently in place. It is estimated that less than about 1.0 percent of the service stations in the United States are equipped to store and deliver natural gas.

There thus is a need for an economical, efficient, fast means for storing compressed natural gas (and other gases) and for delivering such gas to an apparatus which can utilize the gas, such as a motor vehicle. It is an object of this invention to provide such a means.

SUMMARY OF THE INVENTION

In accordance with this invention, there is provided a process for storing and delivering gas. In the first step of this process, a multiplicity of at least four gas banks is filled with compressed gas to a specified pressure, the gas pressure in each of the gas banks is sequentially measured, a control system sequentially selects one of the gas banks and withdraws gas from it to the device to be filled until the rate of gas flow is less than optimum, the control system then withdraws gas from the next sequential of the gas banks while replenishing the gas in the first depleted of said gas banks.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
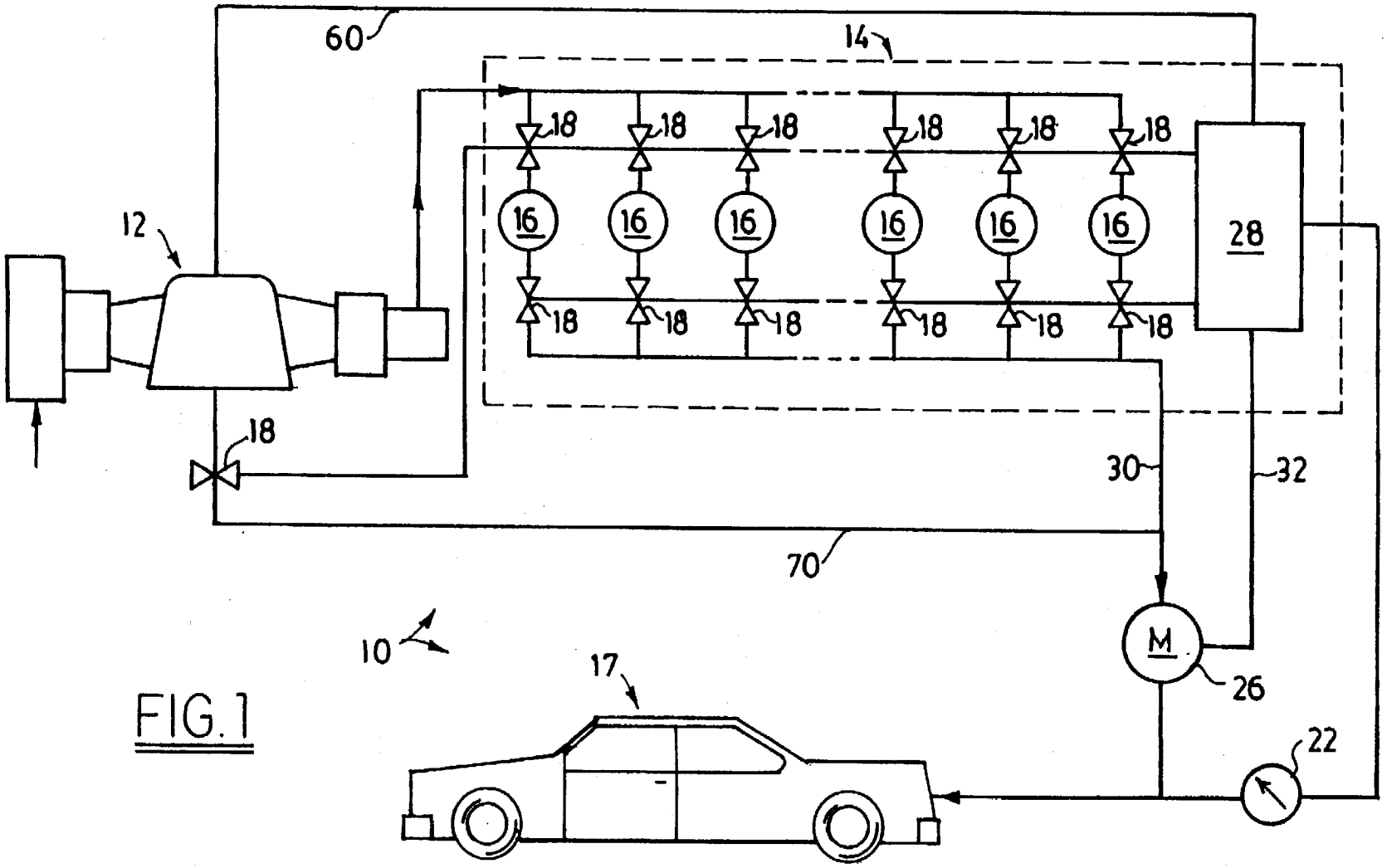
FIG. 1 is a schematic of one preferred embodiment of the invention.

FIG. 1 is a schematic diagram of one preferred embodiment of the invention which, to facilitate comprehension of the invention, has not been drawn to scale.

Referring to FIG. 1, it will be seen that system 10 is comprised of a gas compressor 12 and storage cascade 14. In the embodiment illustrated in FIG. 1, system 10 is delivering compressed natural gas to a motor vehicle 17.

The system 10 of this invention may be used to deliver gas to devices other than motor vehicles. Thus, by way of illustration and not limitation, system 10 can deliver gas to a storage tank, to a self-contained breathing apparatus, a self-contained underwater breathing apparatus, and like. As will be apparent to those skilled in the art, the gas delivered need not be compressed natural gas but may, e.g., be oxygen, air, or any other compressible fluid. For the sake of simplicity of description, the remainder of this specification will refer to the delivery of compressed natural gas, it being understood that the system is applicable to the delivery of other compressible fluids.

Referring again to FIG. 1, it will be seen that system 10 is comprised of gas compressor 12. Any of the gas compressors known to those skilled in the art may be used as gas compressor 12. Thus, e.g., one may use an Ariel JGP/2 balance opposed compressor which is manufactured by the Ariel Corporation of Mount Vernon Ohio. Thus, e.g., one may use one or more of the gas compressors described in U.S. Pat. Nos. 5,351,726 (system and method for compressing natural gas and for refueling motor vehicles), 5,333,465 (underground storage system for natural gas), 5,319,925 (installation for generating electrical energy), 5,313,783, 5,302,090 (method and apparatus for the utilization of the energy in a gas pipeline), 5,263,826 (device for refueling a gaseous fuel tank), 5,234,479 (compressed natural gas dryer system), 5,207,530 (underground compressed natural gas storage and service system), 4,443,156 (automatic natural gas compressor control system), 3,707,157, and the like. The disclosure of each of these United States patents is hereby incorporated by reference into this specification.

In one preferred embodiment, gas compressor 12 is capable of compressing natural gas from a local distribution pressure of about 5 pounds per square inch gauge to a discharge pressure of from about 3,600 to about 4,500 pounds per square inch gauge and at a flow rate of at least about 20 standard cubic feet per minute, at inlet conditions of the compressor. In one aspect of this embodiment, the flow rate of compressor 12 is from about 50 to about 110 standard cubic feet per minute.

In one preferred embodiment, the compressor disclosed in United States patent application 08/300,787 ("Rotary Positive Displacement Device," filed on Sep. 9, 1994) may be used. The entire disclosure of this patent application is hereby incorporated by reference into this specification.

United States patent application 08/300,787 discloses a rotary device comprised of a housing comprising a curved inner surface with a profile equidistant from a trochoidal curve, an eccentric shaft disposed within said housing, a first rotor mounted on said eccentric shaft which is comprised of a first side, a second side, and a third side, a first partial bore disposed at the intersection of said first side and said second side, a second partial bore disposed at the intersection of said second side and said third side, a third partial bore disposed at the intersection of said third side and said first side, a first solid roller disposed and rotatably mounted within said first partial bore, a second solid roller disposed and rotatably mounted within said second partial bore, and a third solid roller disposed and rotatably mounted within said third partial bore.

In the device of such patent application, the rotor is comprised of a front face, a back face, a first side, a second side, and a third side. A first opening is formed between and communicates between the front face and the first side. A second opening is formed between and communicates between the back face and the first side, wherein each of the first opening and the second opening is substantially equidistant and symmetrical between the first partial bore and the second partial bore. A third opening is formed between and communicates between the front face and the second side. A fourth opening is formed between and communicates between the back face and the second side, wherein each of the third opening and the fourth opening is substantially equidistant and symmetrical between the second partial bore and the third partial bore. A fifth opening is formed between and communicates between the front face and the third side. A sixth opening is formed between and communicates between the back face and the third side, wherein each of the fifth opening and the sixth opening is substantially and equidistant and symmetrical between the third partial bore and the first partial bore.

In the device of patent application 08/300,870, each of the first partial bore, the second partial bore, and the third partial bore is comprised of a centerpoint which, as the rotary device rotates, moves along a trochoidal curve. Furthermore, each of the first opening, the second opening, the third opening, the fourth opening, the fifth opening, and the sixth opening has a substantially U-shaped cross-sectional shape defined by a first linear side, a second linear side, and an arcuate section joining said first linear side and said second linear side, wherein the first linear side and the second linear side are disposed with respect to each other at an angle of less than ninety degrees, and the substantially U-shaped cross sectional shape has a depth which is at least equal to its width.

Additionally, in the device of application 08/300,787, the diameter of the first solid roller is equal to the diameter of the second solid roller, and the diameter of the second solid roller is equal to the diameter of the third solid roller. The widths of each of the first opening, the second opening, the third opening, the fourth opening, the fifth opening, and the sixth opening are substantially the same, and the width of each of these openings is less than the diameter of the first solid roller. Furthermore, each of the first side, the second side, and the third side has substantially the same geometry and size and is a composite shape comprised of a first section and a second section, wherein said first section has a shape which is different from said second section.

Referring again to FIG. 1, it will be seen that compressor 12 is operatively connected to a series of at least four cascade banks 16 which are adapted to receive, store, and deliver pressurized gas. As is known to those skilled in the art, each of cascade banks 16 may be comprised of a single storage container such as, e.g., a storage cylinder, sphere, or an nonsymetrically shaped container. In one embodiment, however, cascade bank 16 comprises a multiplicity of storage containers.

Cascade banks 16 are well known to those skilled in the art and are described, e.g., in U.S. Pat. Nos. 5,351,726, 5,333,465, 5,207,530, 5,052,856, 4,805,674, 3,990,248, 3,505,996, and the like. The disclosure of each of these patents is hereby incorporated by reference into this specification.

Figure 3:
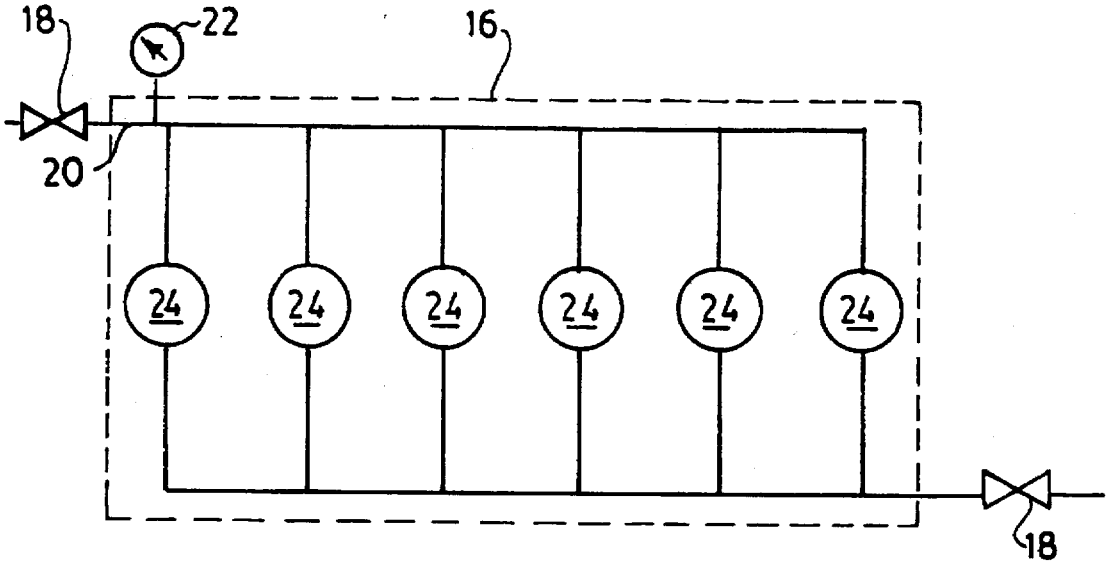
FIG. 3 is a schematic of a typical cascade bank used in the embodiments of FIGS. 1 and 2.

FIG. 3 illustrates one preferred cascade bank 16 which may be used in the apparatus and the process of this invention. Referring to FIG. 3, it will be seen that cascade bank 16 is connected to a source of compressed gas (not shown) via valve 18. In the embodiment illustrated in FIG. 3, the pressure of gas flowing through line 20 is monitored by pressure meter 22.

Many of the pressure meters adapted to measure gas pressure may be used as meter 22. Thus, by way of illustration and not limitation, one may use one or more of the gas pressure meters disclosed in U.S. Pat. Nos. 5,339,844, 5,338,326, 5,311,014, 5,275,007, 5,273,127, 5,271,277, 5,259,424, 5,252,007, and the like. The disclosure of each of these United States patents is hereby incorporated by reference into this specification.

Referring again to FIG. 3, it will be seen that the gas passing through line 20 is distributed to a multiplicity of gas containers (such as, e.g., gas cylinders or spheres or nonsymmetrical containers) 24 which are connected in parallel.

The number of containers, gas cylinders, or spheres 24 which will be used will vary, depending upon the space available for system 10, the capacity of each gas cylinder or sphere 24, etc.

In one preferred embodiment, gas cascade bank 16 is comprised of only one container, gas cylinder or sphere 24. However, as will be apparent to those skilled in the art, from about 1 to about 20 or more containers, gas cylinders, or spheres may be used in each gas bank 16, and the number and the number of cylinders or spheres or containers 24 per gas bank 16 may vary.

Figure 2:
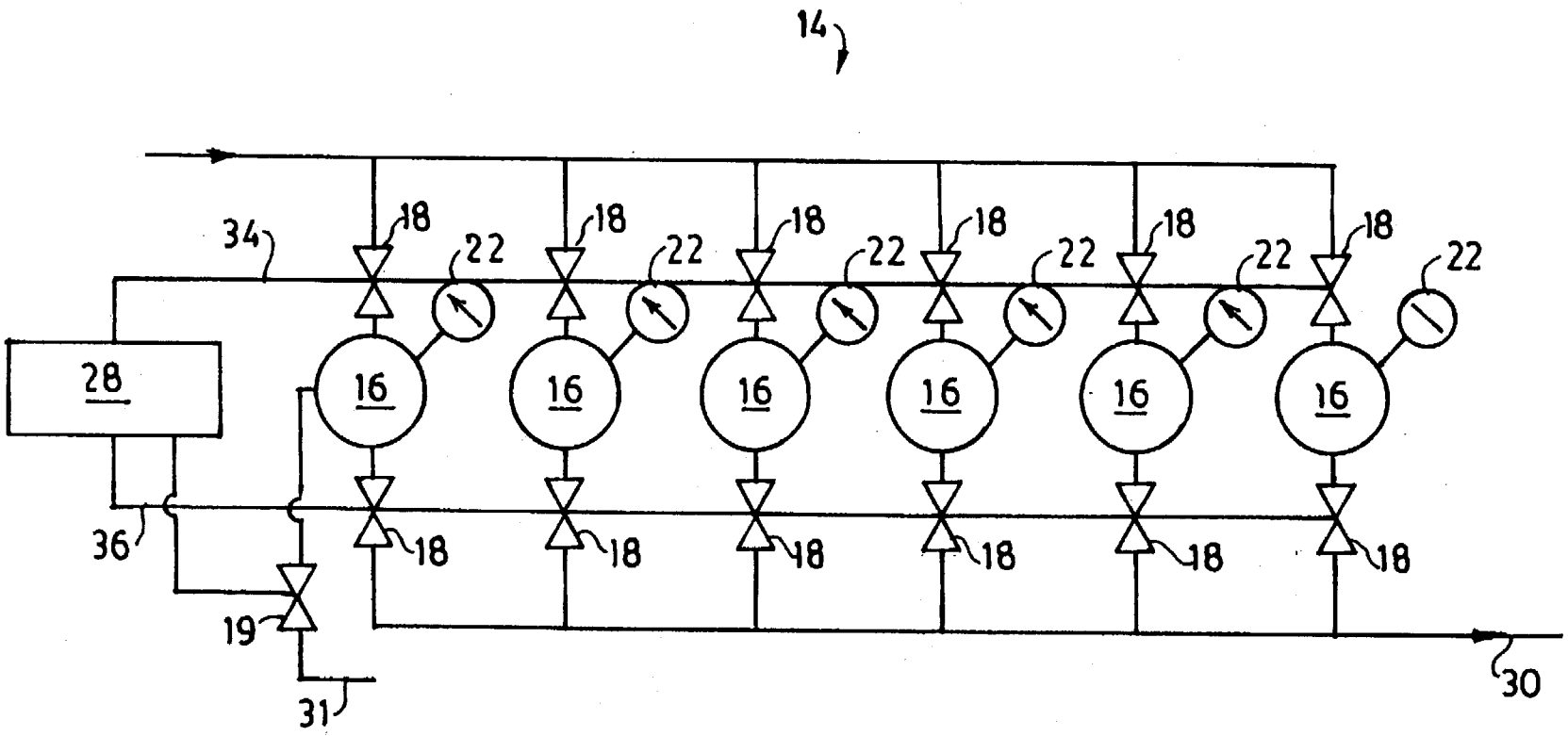
FIG. 2 is a schematic of another preferred embodiment of the invention.

Referring again to FIGS. 1 and 2, it will be apparent to those skilled in the art that, in the preferred embodiment illustrated in FIGS. 1 and 2, a multiplicity of gas banks 16 may be used. In general, at least four such gas banks 16 are required, it being preferred to use more than six such gas banks 16 and, even more preferably, at least about ten such gas banks 16. In one embodiment, the number of gas banks 16 used, when divided by 2, produces an odd number.

Referring again to FIGS. 1 and 2, it will be seen that valves 18 are operatively connected to controller 28, which, in response to information provided by transducers 22, controls the flow of gas into and out of each of the gas banks 16. In the embodiment illustrated, such control is effected by opening and/or closing one or more of the valves 18.

Referring again to FIG. 2, it will be apparent to those skilled in the art that the valves 18 connected on the line 34 side of gas banks 16 are the input valves, and the valves 18 connected on the line 36 side of gas banks 16 are the output valves. Furthermore, although only one output valve 18 is shown per gas bank 16, several such output valves 18 can be used. Thus, e.g., referring to FIG. 2, one of the gas banks 16 is shown connected to a first valve 18 (which feeds output line 30) and, additionally, to valve 19, which is connected to output line 31. It will be apparent to those skilled in the art that, in this embodiment, each of the gas banks 16 is preferably connected to a second valve 19 and, thereafter, to a line 31; but these details have been omitted from FIG. 2 for the sake of simplicity of representation. It will also be apparent to those skilled in the art that each of the gas banks 16 may also be connected to a third valve 21, a fourth valve 23, etc. (not shown) to feed a multiplicity of output lines. It will also be apparent that each such separate output line must have connections (not shown) from controller 28 to the separate valves and meters (not shown).

Referring again to FIG. 1, it will also be apparent that, where there is a multiplicity of output lines 30, each of them preferably will be operatively connected to a flow meter 26 and a pressure meter 22, as illustrated in FIG. 1 for line 30.

Any of the controllers for regulating natural gas flow known to those skilled in the art may be used as controller 28.

By way of illustration, one may use the controller described in U.S. Pat. No. 5,238,030, the entire description of which is hereby incorporated by reference into this specification. This patent discloses a method and apparatus for dispensing natural gas in which a supply plenum is connected to a source of compressed natural gas (CNG) and a control valve assembly for turning on the flow of the gas through a sonic nozzle and out through a dispensing hole. Pressure and temperature transducers connected to the supply plenum measure the stagnation pressure and the temperature of the gas and the ambient temperature. An electronic control system connected to the temperature and pressure transducers and to a control valve assembly calculates a vehicle tank cutoff pressure.

By way of further illustration, one may use the controller disclosed in U.S. Pat. No. 5,259,424, the entire disclosure of which is hereby incorporated by reference into this specification. The controller of this patent is similar to the controller of U.S. Pat. No. 5,238,030.

As will be apparent to those skilled in the art, one may use many of the valves known to those skilled in the art which are suitable for controlling gas flow. Thus, referring to pages 6-54 to 6-57 of Robert H. Perry et al.'s "Chemical Engineeers' Handbook," Fifth Edition (McGraw-Hill Book Company, New York, 1973), one may use any valve suitable for the desired pressure application. The valves used may be mechanically actuated and/or hydraulically auctuated and/or pneumatically actuated and/or electrically actuated.

In one preferred embodiment, valve 18 is electrically activated and, preferably, is a solenoid valve.

Referring again to FIG. 1, it will be seen that a gas flow meter 26 is preferably connected to line 30 to monitor the flow rate of gas being delivered to automobilie 17. The information sensed by meter 26 is passed via line 32 to controller 28 which, in response to such information and/or information furnished from pressure transducers 22 via lines 34 and 36, decides which of valves 18 to open or close, as will be described hereinafter in greater detail.

Referring again to FIG. 1, it will be seen that, in the the preferred embodiment depicted, pressure meter 22 is connected to line 30 to evaluate the pressure of the gas within automobile 17.

Figure 4:
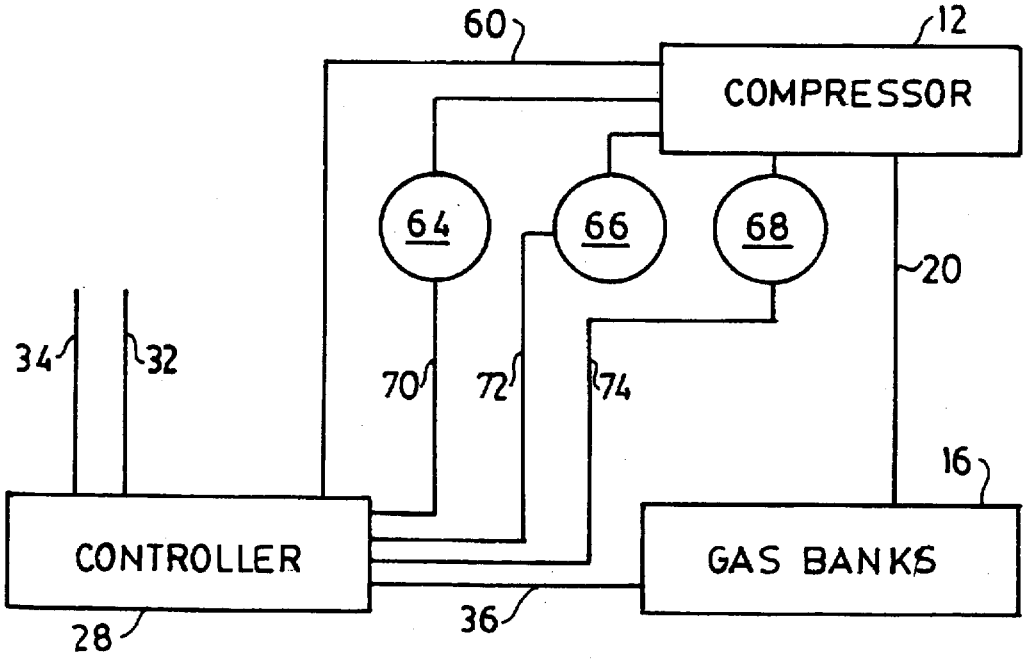
FIG. 4 is a flow diagram of one preferred process of this instant invention.

In the first step of the process of this invention, and referring to FIG. 4, controller 28 evaluates information furnished via line 34 to it from the pressure meters 22 (see FIG. 2) and determines the pressure in each of the gas banks 16. Thereafter, or simultaneously, it evaluates information fed to it via 32 and checks the pressure in vehicle 17 via the pressure transducer 22 (see FIG. 1).

Upon evaluating this information, the controller 28 determines, for each and every point in time, which of the gas banks 16 should be used to fill the vehicle 17. As will be apparent to those skilled in the art, the optimum flow rate into vehicle 17 will occur at an optimum pressure differential between a gas bank 16 and vehicle 17. Once one particular gas bank 16 is used to fill vehicle 17, the pressure differential will continuously vary. At a certain point the pressure differential will be substantially less than optimum, and this will be sensed by controller 28 and cause it to switch to another of the gas banks which will provide a more desirable pressure differential.

Figure 5:
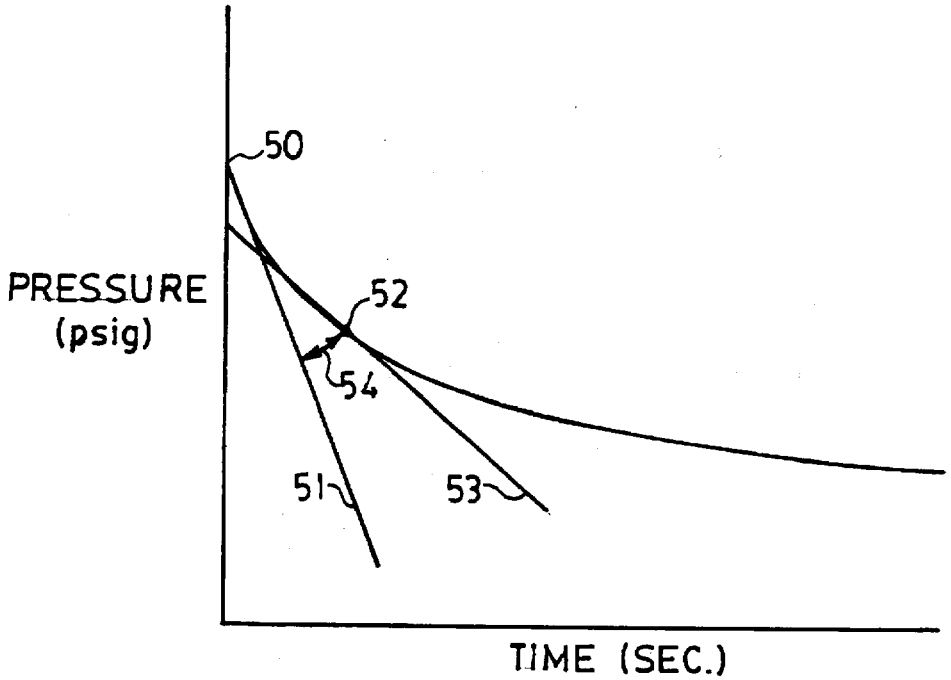
FIGS. 5 and 6 are graphs of the pressure and mass flow in a particular gas bank of the embodiment of FIG. 1.

FIG. 5 is a graph of how the pressure of a particular gas bank 16 varies over time as gas is being delivered from it to a vehicle 17. Referring to FIG. 5, it will be seen that, at point 50, the flow of gas commences from a particular gas bank 16. At this point 50, the first derivative 51 of the pressure/time curve has a certain steep slope, indicating a relatively high flow rate of gas from said gas bank 16. However, as more gas flows from gas bank 16, the pressure in gas bank 16 decreases, the pressure in vehicle 17 increases, the differential in pressure between gas bank 16 and vehicle 17 decreases, and the flow rate also decreases. Thus, e.g., at point 52, the first derivative 53 of the curve has a substantially smaller slope, indicating a substantially lower flow rate.

The controller 28 monitors the difference 54 between the slope 53 and 51 and, when it reaches a certain value (which continually varies, depending upon the pressure conditions), will then switch to another of the gas banks 16 which provide a difference of pressure which is more suitable for the conditions that prevail in vehicle 17.

Figure 6:
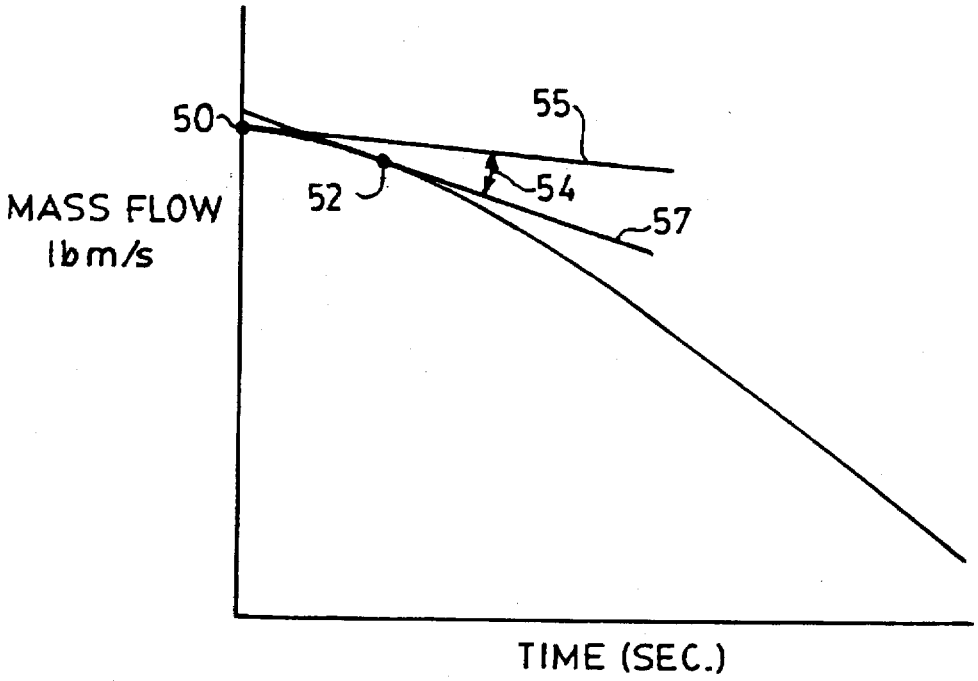

Alternatively, or additionally, controller 28 may also monitor the flow rate into vehicle 17 via meter 26 (see FIG. 1) to achieve the same result. Referring to FIG. 6, at point 50, when gas is first being delivered to vehicle 17, the flow rate to vehicle 17 is at a maximum, the pressure differential between vehicle 17 and gas bank 16 being at a maximum. The slope 55 at point 50 is at a minimum at this point in time. As the pressure differential decreases, however, the slope increases. Thus, e.g., at point 52, the slope 57 is greater than the slope 55, indicating a lower gas delivery rate. As before, controller 28 continually monitors the pressure in vehicle 17 and the pressures in each of gas banks 16 and determines, for each point in time, what the optimum slope (corresponding the optimum pressure) should be. When the slope of the flow rate/time curve departs from the ideal by a predetermined specified amount, the controller 18 then switches to a gas bank 16 with a more suitable gas pressure.

Referring again to FIG. 4, the controller 28 passes information via line 36 to gas banks 16 and, in accordance with the process described above, switches from one of such gas banks to another when the gas pressure differential between the gas bank 16 currently then being used and the vehicle 17 is less than desired.

Simultaneously, or sequentially, controller 28 passes information via line 60 to compressor 12 and causes it to fill those of gas banks 16 which are less than the ideal pressure.

In one preferred embodiment, the total volume of any particular gas bank 16 (which will be the sum of the volumes of each container in said bank) will vary from about 500 to about 4,000 standard cubic feet. In another embodiment, the total volume of any particular gas bank 16 will vary from about 500 to about 1,000 standard cubic feet.

In one preferred embodiment, which is schematically illustrated in FIG. 4, controller 28 monitors the pressure in gas banks 64, 66, and 68 via lines 70, 72, and 74. Assume, for the sake of argument, that it determines that the pressure in gas bank 64 is ideal for the vehicle 17 (not shown) being filled. It will then cause gas to flow from gas bank 64 to vehicle 17.

When the pressure differential between gas bank 64 and vehicle 17 is less than ideal, in this embodiment it will then access the next gas bank in sequence, gas bank 66 and cause it to supply gas to vehicle 17. Simultaneously, it will cause compressor 12 to fill gas bank 64. Once compressor 12 starts to fill gas bank 64 in this embodiment, it will continue until gas bank 64 has reached its ideal pressure.

In the meantime, the pressure in gas bank 66 is being depleted until, at some point, the controller 28 then switches to gas bank 68. The compressor 12 will continue to fill gas bank 64 until it is full, and then it will start filling the next gas bank in sequence, gas bank 66.

It will be apparent that, in this embodiment, there is preferably sequential sequencing of the banks. The first gas bank is accessed, the second gas bank is accessed, the third gas bank is accessed, and then, at some later point in time after the first gas bank has been accessed, another sequence starts wherein the first gas bank is filled, the second gas bank is filled, the third gas bank is filled, etc. Although it is preferred to utilize at least four such gas banks in the process of this invention, only three gas banks 64, 66, and 68 have been shown for simplicity of representation.

Thus, referring again to FIG. 4, when gas bank 68 has been depleted beyond its useful pressure, the controller 28 again accesses gas bank 64. Thus, there is a "rotating cascade" accessing and thereafter filling banks 64, 66, 68, 64, 66, 68, 64, 66, 68, etc.

Thus, as will be apparent to those skilled in the art, applicants' system provides a substantially infinite cascade system in which decisions to switch from one gas source to another are based upon dynamic, constantly changing pressure conditions.

In one embodiment, illustrated in FIG. 1, line 70 extends from compressor 12 to vehicle 17 and allows one to directly fill vehicle 17 with compressed gas at any desired point in the cycle.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A rotating loop process for delivering compressed natural gas to a gas-containing apparatus, comprising the steps of:

(a) providing a first gas storage bank and a second gas storage bank, a third gas storage bank, a fourth gas storage bank, and a gas compressor;

(b) measuring the gas pressure in said first gas storage bank, said second gas storage bank, said third gas storage bank, said fourth gas storage bank, and said gas-containing apparatus;

(c) sequentially and continuously delivering gas from said first, second, third, and fourth gas storage banks by delivering gas only from said first gas storage bank to said gas-containing apparatus until the gas pressure in said first gas storage bank has decreased to a predetermined low level, and thereafter delivering gas only from said second gas storage bank to said gas-containing apparatus until the gas pressure in said second gas storage bank has decreased to a predetermined low level, and thereafter delivering gas only from said third gas storage bank to said gas-containing apparatus until the gas pressure in said third gas storage bank has decreased to a predetermined low level, and thereafter delivering gas only from said fourth gas storage bank to said gas-containing apparatus until the gas pressure in said fourth gas storage bank has decreased to a predetermined low level, and thereafter delivering gas only from said first gas storage bank to said gas-containing apparatus until the gas pressure in said first gas storage bank has decreased to a predetermined low level, and thereafter delivering gas only from said second gas storage bank to said gas-containing apparatus until the gas pressure in said second gas storage bank has decreased to a predetermined low level, and thereafter delivering gas only from said third gas storage bank to said gas-containing apparatus until the gas pressure in said third gas storage bank has decreased to a predetermined low level, and thereafter delivering gas only from said fourth gas storage bank to said gas-containing apparatus until the gas pressure in said fourth gas storage bank has decreased to a predetermined low level;

(d) sequentially and continuously delivering gas from said compressor to said first, second, third, and fourth gas storage banks by delivering gas from said compressor to only the first of said gas storage banks in which said gas pressure has decreased to said predetermined level, and then to only the second of said storage banks in which said gas pressure has decreased to said predetermined level, and then to only the third of said gas storage banks in which said gas pressure has decreased to said predetermined level, and then to only the fourth of said gas storage banks in which said gas pressure has decreased to said predetermined level, provided that gas is delivered from said compressor to each of said storage banks until said storage bank has reached a predetermined maximum pressure;

(e) after said gas has been delivered by said compressor only to said fourth gas storage bank to fully replenish said fourth storage bank, gas is then delivered by said compressor only to said first gas storage bank to fully replenish said first gas storage bank;

(f) thereafter, after said gas has been delivered by said compressor only to said first gas storage bank to fully replenish said first storage bank, gas is then delivered by said compressor only to said second gas storage bank to fully replenish said second gas storage bank;

(g)thereafter, after said gas has been delivered by said compressor only to said second gas storage bank to fully replenish said second storage bank, gas is then delivered by said compressor only to said third gas storage bank to fully replenish said third gas storage bank; and (h) thereafter, after said gas has been delivered by said compressor only to said third gas storage bank to fully replenish said third storage bank, gas is then delivered by said compressor only to said fourth gas storage bank to fully replenish said fourth gas storage bank, (i) after said gas has been delivered by said compressor only to said fourth gas storage bank to fully replenish said fourth storage bank, gas is then delivered by said compressor only to said first gas storage bank to fully replenish said first gas storage bank;

(j) thereafter, after said gas has been delivered by said compressor only to said first gas storage bank to fully replenish said first storage bank, gas is then delivered by said compressor only to said second gas storage bank to fully replenish said second gas storage bank;

(k) thereafter, after said gas has been delivered by said compressor only to said second gas storage bank to fully replenish said second storage bank, gas is then delivered by said compressor only to said third gas storage bank to fully replenish said third gas storage bank; and (l) thereafter, after said gas has been delivered by said compressor only to said third gas storage bank to fully replenish said third storage bank, gas is then delivered by said compressor only to said fourth gas storage bank to fully replenish said fourth gas storage bank.

2. The process as recited in claim 1, wherein a fifth storage bank and a sixth storage bank are provided.

3. The process as recited in claim 1, wherein each of said storage banks has a capacity of from about 500 to about 4,000 standard cubic feet.

4. The process as recited in claim 1, wherein each of said storage banks consists of one gas container.

5. The process as recited in claim 1, wherein said gas is compressed natural gas.

6. The process as recited in claim 1, wherein said gas is compressed oxygen.

7. The process as recited in claim 1, wherein said compressor is a rotary compressor.

8. The process as recited in claim 1, wherein said compressor provides an discharge pressure of from about 3,600 to about 4,500 pounds per square inch gauge.

* * * * *